US005235948A

United States Patent [19]

Grant et al.

[11] Patent Number: 5,235,948

[45] Date of Patent: Aug. 17, 1993

[54] ADJUSTABLE THROTTLE STOP

[75] Inventors: Barry Grant, Dahlonega; Michael E. Harris, Murrayville, both of Ga.

[73] Assignee: BG 300, Inc., Dahlonega, Ga.

[21] Appl. No.: 916,702

[22] Filed: Jul. 22, 1992

[51] Int. Cl.[5] ..... F02D 11/08

[52] U.S. Cl. ..... 123/342; 123/401

[58] Field of Search ..... 123/342, 401, 396, 398

[56] References Cited

U.S. PATENT DOCUMENTS 3,923,020 12/1975 Gilligan ..... 123/342

4,524,741 6/1985 Corbi ..... 123/342

*Primary Examiner*—Andrew M. Dolinar

*Attorney, Agent, or Firm*—Hopkins & Thomas

[57] ABSTRACT

A throttle valve control system for an automobile having an engine, a carburetor mounted on the engine, a throttle valve in the carburetor for controlling the flow of fuel to the engine, an accelerator pedal, and a throttle linkage interconnected between the accelerator pedal and the throttle valve, the throttle linkage including a throttle linkage adjustment means including a piston/-cylinder assembly (11) for expanding and shortening the effective length of the throttle linkage. A throttle limiting closure assembly (16) is mounted onto the piston/-cylinder assembly (11) and includes a threaded travel rod (39) and a pair of lock nuts (46) for selectively limiting the amount of expansion of the piston rod from the cylinder. A source of compressed gas is provided including a normally open control valve (19) and an gas flow controller (21). The gas flow controller (21) is selectively adjustable to control the rate of gas flow from the control valve to the piston/cylinder assembly in order to control the rate at which the piston retracts into the cylinder and accordingly the rate at which the throttle valve reopens.

14 Claims, 2 Drawing Sheets

ADJUSTABLE THROTTLE STOP

FIELD OF THE INVENTION

The present invention relates to a throttle valve control system for use with an internal combustion engine and, more particularly, to such a system for automatically controlling the opening of a carburetor throttle valve of the engine of a drag race vehicle for a period of time during acceleration of the vehicle.

BACKGROUND OF THE INVENTION

In sanctioned drag racing, there are certain race classes in which the goal of a drag racer is to run a distance, as close as possible, to a predetermined time. A racer who runs the distance faster than this predetermined time has that run disqualified. Since it is standard practice for racers to race with the highest possible rate of acceleration and highest top speed with a car that can achieve speeds considerably greater than the standard speed for the class in which the car will run, some type of throttle valve limiting device customarily is used to slow the car to the standard speed of the class of the car.

Typically, the throttle valve control system employed in racing engines for this purpose comprises a gas controlled piston/cylinder device installed in the throttle linkage between the accelerator pedal and the carburetor, which controls the throttle valve. The linkage from the accelerator pedal is connected to the cylinder of the piston/cylinder device and the linkage from the carburetor is connected to the piston rod mounted to the piston and extending from the cylinder. When the piston/cylinder assembly is retracted, the throttle linkage is at its standard length for normal operation of the carburetor. However, when the piston/cylinder assembly is extended, the throttle linkage moves the carburetor valve toward its closed position.

A source of compressed gas, typically $CO_2$, is delivered into the cylinder chamber, which forces the piston rod to retract into the cylinder, allowing the accelerator pedal linkage to control the carburetor in a conventional manner, i.e., as if the piston/cylinder device were not installed in the system. Thus, upon full depression of the accelerator pedal, the throttle valve opens completely, and upon release of the accelerator pedal, the throttle valve closes.

At the start of a race, the source of compressed gas is communicated with the cylinder to retract the piston so that upon depression of the accelerator pedal the throttle valve opens completely. After a specified time from the start of the race, typically a few seconds, the throttle valve control system vents the compressed gas in the cylinder to the atmosphere which releases the pressure within the cylinder chamber acting against the piston. A spring biasing means attached to the end of the piston rod urges the piston rod from the cylinder, thus causing the carburetor linkage to close the throttle valve. After another predetermined period of time, the throttle valve control system reestablishes communication between the compressed gas source and the cylinder, causing the piston rod to retract into the cylinder and, consequently, the throttle valve to open back up. Throttle valve control systems of this type are not designed to cause the race car to slow down, but rather to have the effect of limiting the rate of acceleration of the car, allowing the racer to achieve a desired race time.

However, throttle valve control systems of this type can cause several problems. First, it is difficult to control the degree of throttle valve closure when the flow of compressed gas to the cylinder is terminated and the gas of the cylinder is vented to the atmosphere. In practice, the throttle valve moves toward a closed position and continues to move toward its closed position until the flow of compressed gas to the cylinder is reestablished. To limit the extent of throttle valve closure, some systems utilize an adjustment bolt screwed into the back of the cylinder, which bolt connects the linkage from the accelerator pedal to the cylinder. This bolt adjusts the position of the cylinder relative to the accelerator pedal and therefore adjusts the overall length of the throttle linkage between the cylinder and the accelerator pedal and, thereby limits the extent to which a fully extended piston rod can cause the throttle valve to close. However, because there is only a limited amount of travel of the accelerator pedal and the cylinder when moved by the accelerator pedal, such an arrangement typically has little or no effect in racing applications wherein the compressed gas source is reestablished to the cylinder prior to the piston rod fully extending from the cylinder. In addition, the throttle linkage has to be loosened from the cylinder in order to adjust the bolt, an adjustment procedure that is complicated.

Second, prior art throttle limiting designs are not easily adjustable to be adapted to variable racing conditions, such as weather and track conditions. Another problem with prior art systems is that, upon recharging the cylinder with compressed gas, the throttle valve opens quickly due to the force of the compressed gas retracting the piston. Rapid throttle opening can cause the tires to spin and the vehicle to become unstable.

Accordingly, a heretofore unaddressed need exists for a throttle valve control system that can control the degree of throttle closure upon expansion of the throttle linkage, that includes a simple adjustment mechanism for adapting the throttle valve control system to variable racing conditions, and that can control the rate of throttle reopening upon expansion of the throttle linkage. It is to the provision of such a throttle valve control system that the present invention is primarily directed.

SUMMARY OF THE INVENTION

Briefly described, the present invention comprises, in a preferred embodiment thereof, a throttle valve control system including a piston/cylinder assembly interconnected in the throttle linkage between an accelerator pedal and carburetor of an engine of a drag racing vehicle, a source of compressed gas for retracting the piston rod into the cylinder of the piston/cylinder assembly, and a spring biasing means for urging the piston rod from the piston/cylinder assembly, wherein the throttle valve control system is provided with a piston rod travel limiting assembly for limiting the extension of the piston rod from the cylinder. When the source of compressed gas is shut off to the cylinder, the spring biasing means urges the piston rod from the cylinder and the compressed gas in the cylinder is vented to atmosphere. The piston rod travel limiting assembly functions to stop the extension of the piston rod from the cylinder at a selectively adjustable point in order to prevent the throttle valve from moving too far towards a closed position. The selectively adjustable feature of the piston rod travel limiting assembly provides a driver with a readily adjustable means for fine tuning the throttle valve control system to account for variable racing conditions.

The piston rod travel limiting assembly includes a threaded travel rod mounted at one of its ends to the piston rod, a stop plate mounted to the cylinder for slidably supporting the travel rod intermediate of its ends, and a lock nut adapted to engage the stop plate upon extension of the piston rod from the cylinder at a predetermined set limit. The degree of piston rod extension is selectively controlled by adjusting the position of the lock nut on the travel bar.

The throttle valve control system further includes an gas flow controller in communication between the source of compressed gas and the cylinder chamber. The gas flow controller limits the rate of gas flow into the cylinder, yet allows gas to flow from the cylinder unrestricted. Thus, when the compressed gas is reestablished to the cylinder chamber after the throttle valve control system has throttled back the throttle valve, the rate at which the piston rod retracts into the cylinder, and consequently, the rate at which the throttle valve reopens, is controllably limited. As previously stated, this helps prevent tire spin and vehicle instability.

Accordingly, it is an object of the present invention to provide a method and apparatus for expanding and contracting the throttle linkage between the accelerator pedal and carburetor pedal of a drag race vehicle to achieve a desired race time for the vehicle.

Another object of the present invention is to provide a method and apparatus for limiting the rate of expansion of the throttle linkage of a drag race vehicle that is simple in design, inexpensive to manufacture, and reliable in operation.

Another object of the present invention is to provide a method and apparatus for selectively limiting the expansion of the piston rod from the piston/cylinder assembly of a throttle valve control system.

Another object of the present invention is to provide a method and apparatus for selectively controlling the contraction of the throttle linkage controlled by a throttle valve control system in an adjustable length throttle linkage assembly of a motor vehicle.

Another object of the present invention is to provide a method and apparatus that efficiently and reliably functions in providing drag racers a means for adjusting the throttle valve control system in response to changing racing conditions.

Another object of the present invention is to provide a method and apparatus for limiting tire spin and resultant vehicle instability caused by rapid reopening of the throttle valve after the throttle linkage has been extended.

Other objects, features, and advantages of the present invention will become apparent from the following detailed description, when read in conjunction with the accompanying drawings.

DETAILED DESCRIPTION

Figure 1:
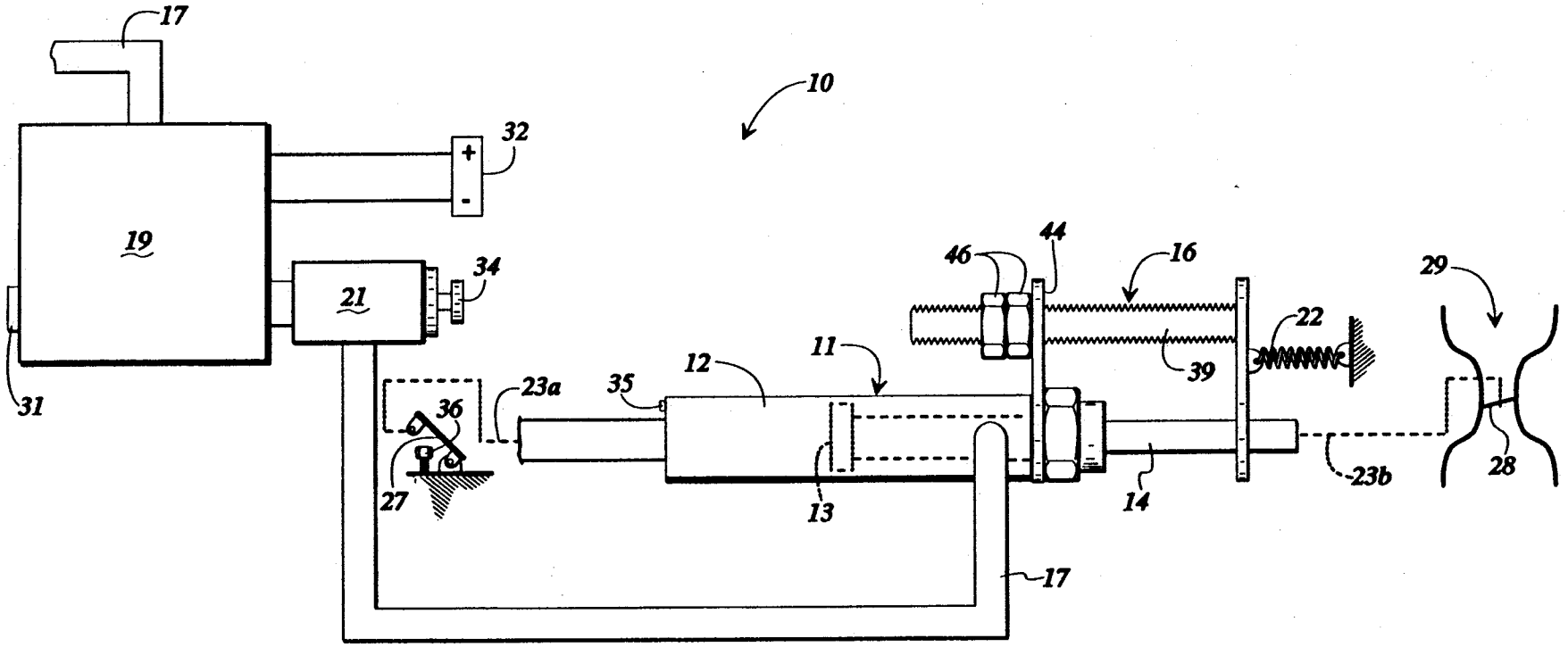
FIG. 1 is a diagrammatic view of the throttle valve control system constructed in accordance with a preferred embodiment of the present invention.

Referring now in more detail to the drawings, in which like numerals represent like parts throughout the several views, FIG. 1 illustrates a throttle valve control system 10 that embodies the principles of the present invention in a preferred form. The throttle valve control system 10 comprises generally a piston cylinder assembly 11, including a cylinder 12, a piston 13, and a piston rod 14, a throttle closure limiting assembly 16, a source of compressed gas 17, a gas control valve 19, a one-way gas flow controller 21, and a carburetor return tension spring 22. The throttle valve control system 10 is shown installed in the throttle linkage 23*a*, 23*b* interconnected between an accelerator pedal 27 and a throttle valve 28 that is controlled by a carburetor 29.

The control valve 19 has a gas valve that is a normally opened valve for allowing fluid communication between the source of compressed gas 17 and the cylinder 12 when the gas valve is in its normally open position, and for closing off such fluid communication when the valve is in its closed position. The control valve 19 includes an exhaust port 31, which is closed off when the normally open gas valve of the control valve 19 is open and which is opened when the normally open gas valve of the control valve 19 is closed. A model 4200-05-5282 control valve manufactured by Spartan Scientific, Inc. has been found to perform satisfactorily in operation. An electric timer 32 controls the opened and closed operation of control valve 19. However, alternatively, electric timer 32 can be replaced by a manual control switch operated by a driver of the automobile, or any other suitable control means.

When the electric timer 32 is de-energized, the gas valve of the control valve 19 is opened up and compressed gas is supplied through the control valve 19 to the gas flow controller 21. The gas flow controller 21 has an adjustable flow control switch 34 for controlling the rate of gas flow to the cylinder 12. The gas flow controller 21 is a one-way controller, and thereby only operates to restrict the rate of gas flow from the control valve 19 to the piston/cylinder assembly 11 and not the flow of gas, in the opposite direction, from the cylinder chamber 12 to the control valve 19 and out exhaust port 31. A model 7765-5611 flow controller, manufactured by Legries, Inc., Youngstown, Ohio, U.S.A. has been found to perform satisfactorily in operation. The operation of the control valve 19 and the gas flow controller 21 will be discussed hereinafter.

The piston/cylinder assembly 11 is adapted to receive compressed gas at one end of cylinder 12. An increase in pressure of the compressed gas causes the piston 13 and the piston rod 14 to retract into the cylinder 12. A vent 35 is provided in the cylinder 12 at the end of the cylinder opposite the cylinder end that receives the compressed gas. The cylinder 12 is connected to the throttle linkage 23*a* between the cylinder and the accelerator pedal 27. An accelerator pedal depression limiting bolt 36 is secured below the accelerator pedal 27 to the floor board of the vehicle. The limiting bolt 36 limits the depression of the accelerator pedal 27 and is adjustable for setting the maximum depression of the accelerator pedal to correspond with the maximum open position of the throttle valve 28.

The piston rod 14 is connected to the throttle linkage 23*b* between the piston rod 14 and the throttle valve 28. The carburetor return tension spring 22 serves two functions: one, to close the throttle valve 28 upon release of the accelerator pedal 27 and two, to bias the piston rod 14 from the cylinder 12 in conjunction with the throttle closure limiting assembly 16, as explained hereinafter.

Figure 2:
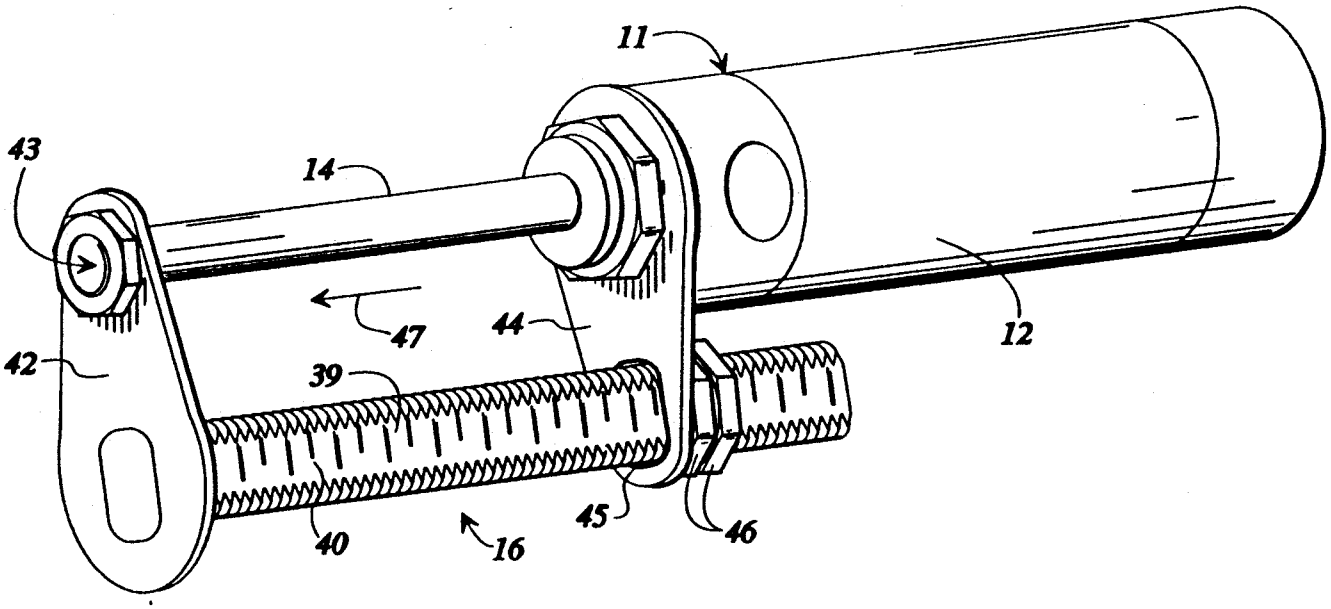
FIG. 2 is a perspective view of the throttle closure limiting assembly and the piston/cylinder assembly of FIG. 1.

FIG. 2 is a perspective view of the throttle closure limiting assembly 16 and the piston/cylinder assembly 11. The throttle closure limiting assembly comprises a threaded travel rod 39 having opposed flat sides 40 (only one side shown). The threaded travel rod 39 is mounted at one end to an oval carrier plate 42, which is mounted to the distal end 43 of the piston rod 14. The threaded travel rod 39 is supported intermediate of its ends by an oval shaped guide plate 44 having an oval shaped opening 45 therein to slidably guide the threaded rod 39 along its opposed flat sides 40. The oval shaped guide plate 44 is mounted to the cylinder 12. A pair of lock nuts 46 are threadably mounted on to the travel rod 39 and function to engage the oval shaped guide plate 44 as the piston 14 extends from the cylinder 12 in the direction indicated by arrow 47. By selectively adjusting the position of the lock nuts 46 along the threaded rod 39, the degree of piston rod extension can be limited.

In operation, at the start of a race, the electric timer 32 is de-energized while the source of compressed gas 17 provides compressed gas to control valve 19, the gas valve of which is in its normally open position. The flow of compressed gas from control valve 19 is restricted by the gas flow controller 21, which limits the introduction of compressed gas into cylinder 12. This causes the piston rod 14 to retract slowly into the cylinder chamber 12 until the piston rod is fully retracted. With the piston rod 14 fully retracted, the accelerator pedal 27 directly controls the opening of the throttle valve 28, allowing for maximum acceleration of the automobile. So arranged, the throttle valve control system 10 is positioned for the start of the race.

After a preselected time from the start of the race, the electric timer 32 is energized and the normally opened gas valve of the control valve 19 is closed. This shuts off the source of compressed gas 17 to the cylinder 12 and causes the carburetor return tension spring 22 to bias the piston rod 14 from the cylinder 12. The compressed gas in the cylinder is be routed back, unrestricted by the gas flow controller 21, through the control valve 19 where it is relieved to atmosphere through the exhaust port 31. The piston rod 14 extends from the cylinder 12 until the lock nuts 46 engage the guide plate 44. At this point the throttle valve 28 is limited from closing any further.

After another predetermined amount of time, the electric timer 32 is de-energized, causing the gas valve of the control valve 19 to re-open and the exhaust port 31 to shut. Compressed gas is reintroduced into the cylinder chamber 12 through the gas flow controller 21. The flow controller 21 restricts the rate of gas flow from the control valve 19 to the cylinder chamber 12. Through the adjustment of flow control switch 34, the rate at which the piston rod 14 retracts into the cylinder 12 can be selectively controlled. As the piston rod 14 gradually retracts into the cylinder 12, the throttle valve 28 reopens to a position for maximum acceleration. Thus, it can be seen that the piston cylinder assembly 11, the carburetor return tension spring 22, and the source of compressed gas 17 function as a throttle linkage adjustment means for expanding and shortening the effective length of the throttle linkage between the accelerator pedal and the carburetor. Likewise, it can be seen that the throttle closure limiting assembly 16 functions as a means for selectively limiting the amount that the throttle linkage adjustment means expands the throttle linkage.

Making the throttle closure limiting assembly adjustable allows a racer to compensate for changing weather and track conditions, and positioning the adjustment mechanism on the piston/cylinder assembly provides for easy access to the limiting assembly for adjustment thereof. By providing for a gradual reopening of the throttle valve after it has been throttled back, the present invention prevents the dangers of tire spin and vehicle instability caused by sudden application of full throttle.

The features and principles of the present invention have been illustrated in the foregoing description of a preferred embodiment thereof. It will be apparent to those skilled in the art that numerous changes or modifications may be made thereto without departure from the spirit and scope of the invention.

We claim:

1. In a throttle valve control system for an automobile including an engine, a carburetor mounted on the engine, a throttle valve in the carburetor for controlling the flow of fuel to the engine, an accelerator pedal, and a throttle linkage interconnected between the accelerator pedal and the throttle valve, the improvement therein comprising:

the throttle linkage including a throttle linkage adjustment means constructed and arranged to expand and shorten the effective length of the throttle linkage, and throttle closure limiting means for selectively limiting the amount that said throttle linkage adjustment means expands the effective length of the throttle linkage, so that when said throttle linkage adjustment means shortens the effective length of the throttle linkage, the accelerator pedal directly controls the maximum open setting of the throttle valve for maximum acceleration of the automobile, and when said throttle linkage adjustment means expands the throttle linkage, said throttle closure limiting means limits the expansion of the effective length of the throttle linkage at a predetermined maximum limit, thus limiting the closure of the throttle valve to a selected limit for decreasing the acceleration of the automobile.

2. The throttle valve control system of claim 1, wherein said throttle linkage adjustment means comprises a piston/cylinder assembly including a piston rod adapted to reciprocate from one end of a cylinder, a source of compressed gas in communication with said piston/cylinder assembly for urging said piston rod in a first direction, and means for biasing said piston rod in a second direction opposite to said first direction, and wherein said throttle closure limiting means comprises a limiting assembly for limiting the travel of said piston rod and said cylinder with respect to each other.

3. The throttle valve control system of claim 2, wherein said limiting assembly comprises a travel rod mounted at one of its ends to said piston rod, stop means mounted to said cylinder for slidably supporting said travel rod intermediate of its ends, and a travel rod adjustment member selectively adjustable along said travel rod, said stop means adapted to engage said travel rod adjustment member upon movement of said piston rod within said cylinder.

4. The throttle valve control system of claim 3, wherein said piston rod is coupled to the carburetor, said cylinder is coupled to the accelerator pedal, and said stop means is adapted to engage said travel rod adjustment member upon extension of said piston rod from said cylinder.

5. The throttle valve control system of claim 2, wherein said throttle closure limiting means is external of said piston/cylinder assembly.

6. The throttle valve control system of claim 2, wherein said throttle closure limiting means can be selectively adjusted to limit the expansion of the effective length of the throttle linkage in a manner independent of the accelerator pedal and the throttle linkage between the piston/cylinder and the accelerator pedal, whereby an adjustment of said throttle closure limiting means does no cause an appreciable effect on the position of the accelerator pedal.

7. The throttle valve control system of claim 1, wherein said throttle linkage adjustment means comprises throttle opening limiting means for limiting the rate at which said throttle linkage adjustment means shortens the effective length of the throttle linkage.

8. The throttle valve control system of claim 7, wherein said throttle linkage adjustment means comprises a piston/cylinder assembly including a piston rod adapted to reciprocate from one end of said cylinder and a source of compressed gas in communication with said piston/cylinder assembly for actuating said piston rod to shorten the effective length of the throttle linkage, and wherein said throttle opening limiting means comprises an gas flow controller for controlling the rate of gas flow between said source of compressed gas and said piston/cylinder assembly.

9. A method for controlling a throttle valve of a carburetor mounted on an engine of an automobile including an accelerator pedal and throttle linkage interconnected between the accelerator pedal and throttle valve, said method comprising the steps of expanding the effective length of the throttle linkage to close off the throttle valve for decreasing the acceleration of the automobile, shortening the effective length of the throttle linkage to reopen the throttle valve for maximum acceleration, and selectively limiting the expansion of said throttle linkage to control the effect that expanding the effective length of the throttle linkage has on the acceleration of the automobile.

10. The method of claim 9 wherein the steps of expanding and shortening the effective length of the throttle linkage include controlling the movement of a piston rod within a piston/cylinder assembly in the throttle linkage, wherein the extension of the piston rod from the piston/cylinder assembly expands the throttle linkage.

11. The method of claim 10, wherein the step of selectively limiting the amount of expansion of said throttle linkage comprises limiting the travel of the piston rod from the cylinder.

12. The method of claim 10, wherein the step of expanding the effective length of the throttle linkage comprises biasing the piston rod from the piston/cylinder assembly.

13. The method of claim 10, wherein the step of expanding the effective length of the throttle linkage comprises providing a source of compressed gas to the piston/cylinder assembly to urge the piston and the piston rod into the cylinder.

14. The method of claim 13, and further comprising the step of limiting the rate of compresses gas flow to the cylinder to control the rate of throttle valve openings.

* * * * *